US006479776B2

(12) United States Patent
Nakase et al.

(10) Patent No.: US 6,479,776 B2
(45) Date of Patent: Nov. 12, 2002

(54) LEVER SWITCH

(75) Inventors: Masaki Nakase, Fukui (JP); Yasuchika Kudo, Fukui (JP); Yusho Nakase, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/985,423

(22) Filed: Nov. 2, 2001

(65) Prior Publication Data

US 2002/0053504 A1 May 9, 2002

(30) Foreign Application Priority Data

Nov. 7, 2000 (JP) ..... 2000-338647

(51) Int. Cl.[7] ..... H01H 15/00
(52) U.S. Cl. ..... 200/559; 200/6 R; 200/16 D; 200/339
(58) Field of Search ..... 200/6 R–6 C, 200/553–561, 16 R–16 D, 339

(56) References Cited

U.S. PATENT DOCUMENTS 3,614,346 A * 10/1971 Gudaitis et al. ..... 200/16 D
4,431,884 A 2/1984 Flumignan et al. ..... 200/67 D
5,796,058 A * 8/1998 Aimi et al. ..... 200/16 D
6,018,132 A 1/2000 Chen ..... 200/406
6,072,139 A * 6/2000 Nakase et al. ..... 200/553
6,222,144 B1 * 4/2001 Nishikawa ..... 200/16 D
6,248,966 B1 * 6/2001 Nakase et al. ..... 200/339

* cited by examiner

*Primary Examiner*—Michael Friedhofer
(74) *Attorney, Agent, or Firm*—Wenderoth, Lind & Ponack, L.L.P.

(57) ABSTRACT

A lever switch comprises a case (11) provided with a common contact (12) and stationary contacts (13, 14), a generally M-shaped movable contact (15) having a middle part (15A) in resilient contact with the common contact (12) and contact points (15E) at both ends thereof, a lever (18) disposed rotatably to the case (11), and a pair of cams (16, 17). The contact points (15E) at both ends of the movable contact (15) are in contact resiliently with two confronting inner walls of the case (11) where the stationary contacts (13, 14) are disposed. The contact points (15E) of the movable contact (15) slide and come into contact resiliently with the stationary contacts by turning motion of the lever (18).

7 Claims, 9 Drawing Sheets

FIG. 9 - PRIOR ART
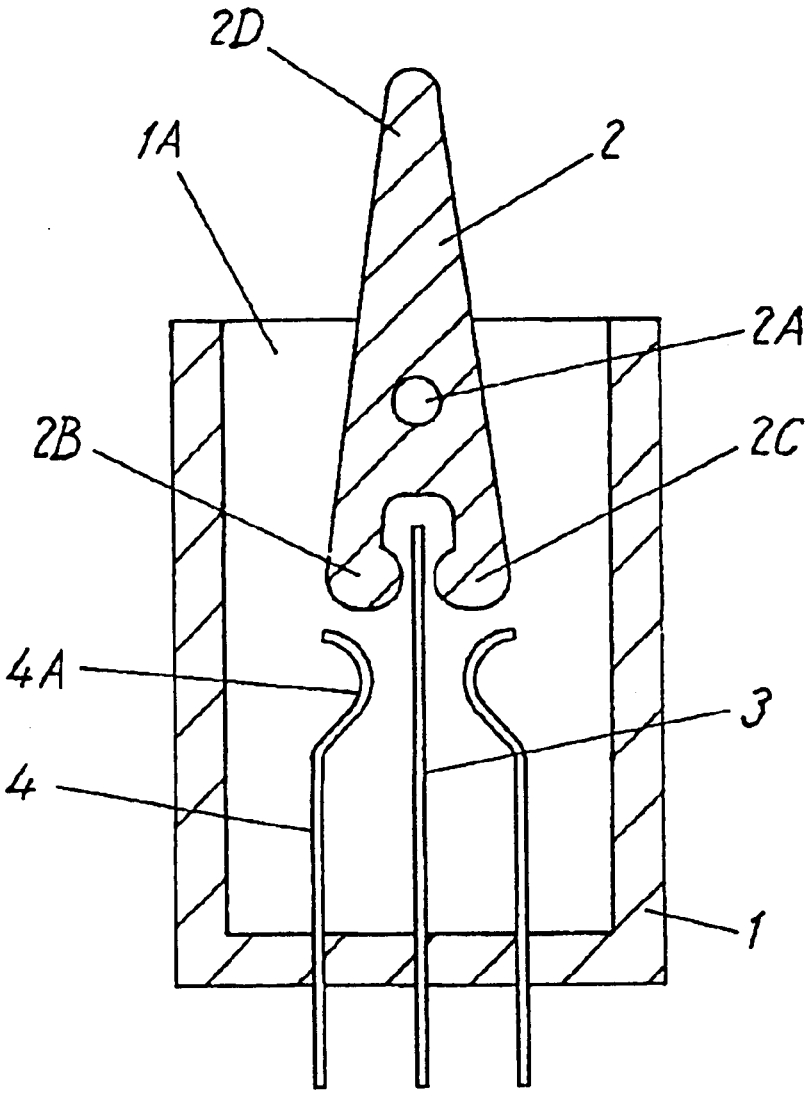

FIG. 10 - PRIOR ART
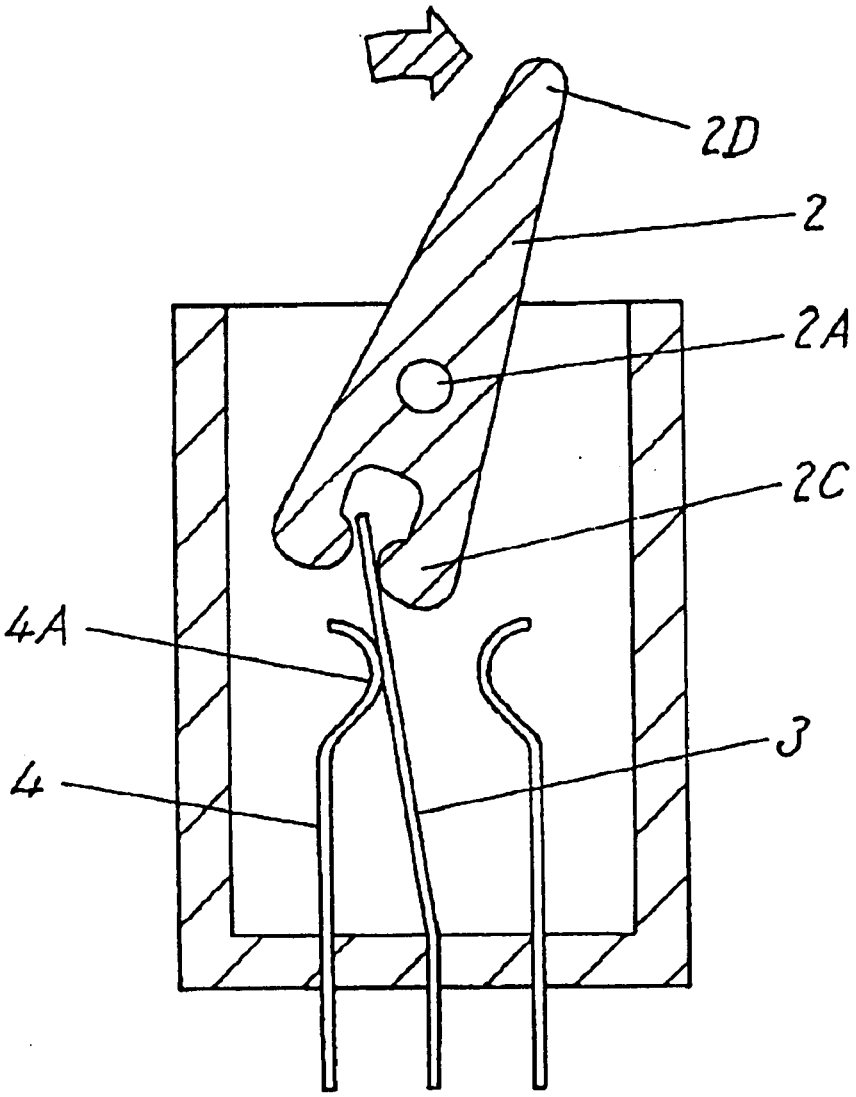

FIG. 11 - PRIOR ART
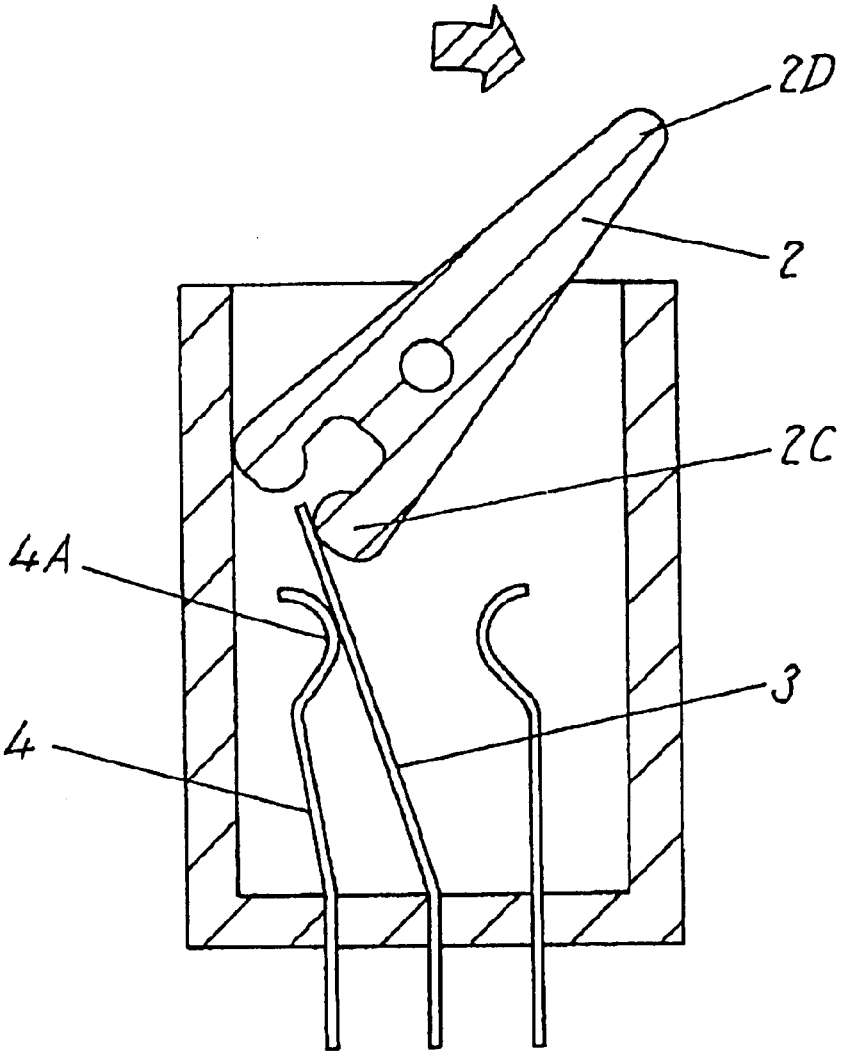

LEVER SWITCH

FIELD OF THE INVENTION

The present invention relates to lever switches used in a variety of electronic devices for detecting presence or absence of a recording medium, an operating condition of mechanism, and the like.

BACKGROUND OF THE INVENTION

A leaf switch, as called commonly, comprised of a movable contact and a stationary contact made of flexible thin sheet metal is known widely as a kind of lever switch for use in a variety of electronic devices for detecting presence or absence of a recording medium such as tape, disk and the like, an operating condition of mechanism, and so on.

One such lever switch of the prior art will be described with reference to FIG. 9 to FIG. 11.

FIG. 9 is a sectioned view depicting a lever switch of the prior art. Box-shaped case 1 made of insulating plastic has an open front and opening 1A in an upper surface. Lever 2 is mounted with shaft 2A to a central portion of the case 1 in a rotatable manner. The lever 2 disposed within the case 1 is provided with actuating parts 2B and 2C at its lower end. Manipulating part 2D at its upper end projects upward from the opening 1A of the case 1.

Movable contact 3 made of flexible thin sheet metal and a pair of stationary contacts 4 also made of flexible thin sheet metal disposed to both sides of the movable contact 3 are inserted and fixed individually in a bottom surface of the case 1 opposite the opening 1A. The movable contact 3 is so disposed that an upper end of it locates between the actuating parts 2B and 2C of the levers 2. The stationary contacts 4 are provided with inwardly curved contacting parts 4A at their upper ends confronting a center area of the movable contact 3. A front face of the case 1, which houses the lever 2, the movable contact 3 and the stationary contacts 4 is covered with a cover (not shown in the figure). The shaft 2A of the lever 2 is thus retained rotatably toward both right and left sides.

In the above-described structure, when the manipulating part 2D of the lever 2 is turned rightward, a lower end of the actuating part 2C turns toward the left side about the shaft 2A as being a fulcrum, as shown in a sectioned view of FIG. 10. This turning movement causes the actuating part 2C to push the upper end of the movable contact 3 and bend it to the left side, so as to render the center area in contact with the contacting part 4A of the left stationary contact 4.

When the manipulating part 2D of the lever 2 is turned further for a predetermined stroke, the upper end of the movable contact 3 shifts further toward the left, and the center area depresses the contacting part 4A, as shown in the sectioned view of FIG. 11. This causes the stationary contact 4 also bend left side, thereby rendering the movable contact 3 and the stationary contact 4 into a state of contacting with each other with a stable contact pressure. When actuating force to the manipulating part 2D is released from the lever 2, resilient returning forces of the movable contact 3 and the stationary contact 4 push the actuating part 2C to the right, and turn the lever 2 in a manner to restore the manipulating part 2D into its neutral position, as shows in FIG. 9.

When the manipulating part 2D of the lever 2 is turned leftward, the actuating part 2B depresses the upper end of the movable contact 3 to the right side, to bend the movable contact 3 to the right, and to make it in contact with the stationary contact 4 on the right side.

However, in the foregoing lever switch of the prior art, the leaf-like movable contact 3 is required to have a length of certain extent in order for it to keep a sufficient permissible stress, since the movable contact 3 is flexed in the right-to-left direction to make it in contact with the stationary contacts 4 at both sides. It is therefore difficult to reduce size of the switch entirely. Furthermore, it also has another problem that conductivity of the contacts tend to became unstable if a stroke given to the lever 2 is small, because of the structure in which a steady contact pressure to the movable contact 3 is obtainable only when the stationary contact 4 is bent after the lever 2 is turned beyond a predetermined amount of stroke.

SUMMARY OF THE INVENTION

The present invention addresses the above-described problems of the prior art, and it is intended to provide a lever switch, which realizes downsizing as well as a stable conductivity of contacts.

A lever switch of this invention comprises:

- a case (11) having an opening in an upper surface, provided with a common contact and stationary contacts, the common contact being disposed to a center area of a first inner wall of the case, and the stationary contacts being disposed to a second inner wall and a third inner wall opposite each other in the case;
- a movable contact (15) having a middle part, first arms extending from both ends of the middle part to a direction of vertical to the first inner wall, turnover parts in continuity with ends of the first arms, second arms in continuity with ends of the turnover parts, and contact points in continuity with the second arms, wherein the middle part (15A) is in contact resiliently with the common contact (12) at all times, and the contact points (15E) are in contact resiliently with the second inner wall and the third inner wall respectively in a slidable manner;
- a pair of cams disposed rotatably to a fourth inner wall of the case, lower surface of a depressing part of each of the pair of cams abutting upon respective turnover part of the movable contact; and
- a lever disposed rotatably to the fourth inner wall of the case, lower side of the lever abutting on the individual depressing parts of the pair of the cams, and an upper part of the lever projecting through the opening in the case.

In the foregoing structure, a turning movement of the lever causes one of the contact points to make resilient contact with one of the stationary contacts.

BRIEF DESCRIPTION OF THE DRAWINGS

FIG. 9 is a sectional view of a lever switch of the prior art;

FIG. 10 is a sectional view of the same lever switch with a lever turned partway; and FIG. 11 is a sectional view of the same lever switch with the lever turned to its full swing.

DETAILED DESCRIPTION OF THE INVENTION

Exemplary embodiments of the present invention will be described hereinafter with reference to the accompanying drawings.

(First Exemplary Embodiment)

Figure 1:
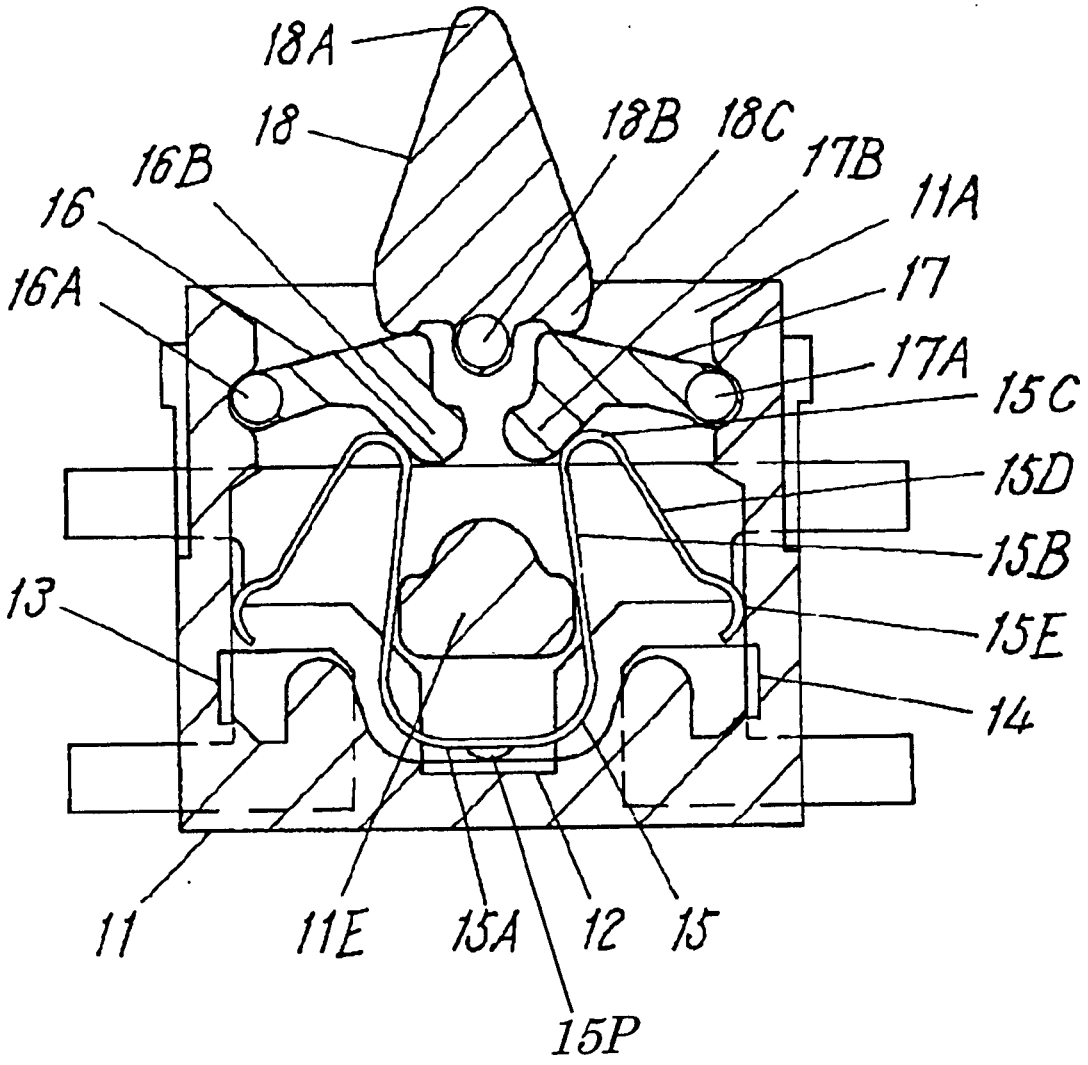
FIG. 1 is a sectional view of a lever switch according to a first exemplary embodiment of the present invention.
Figure 2:
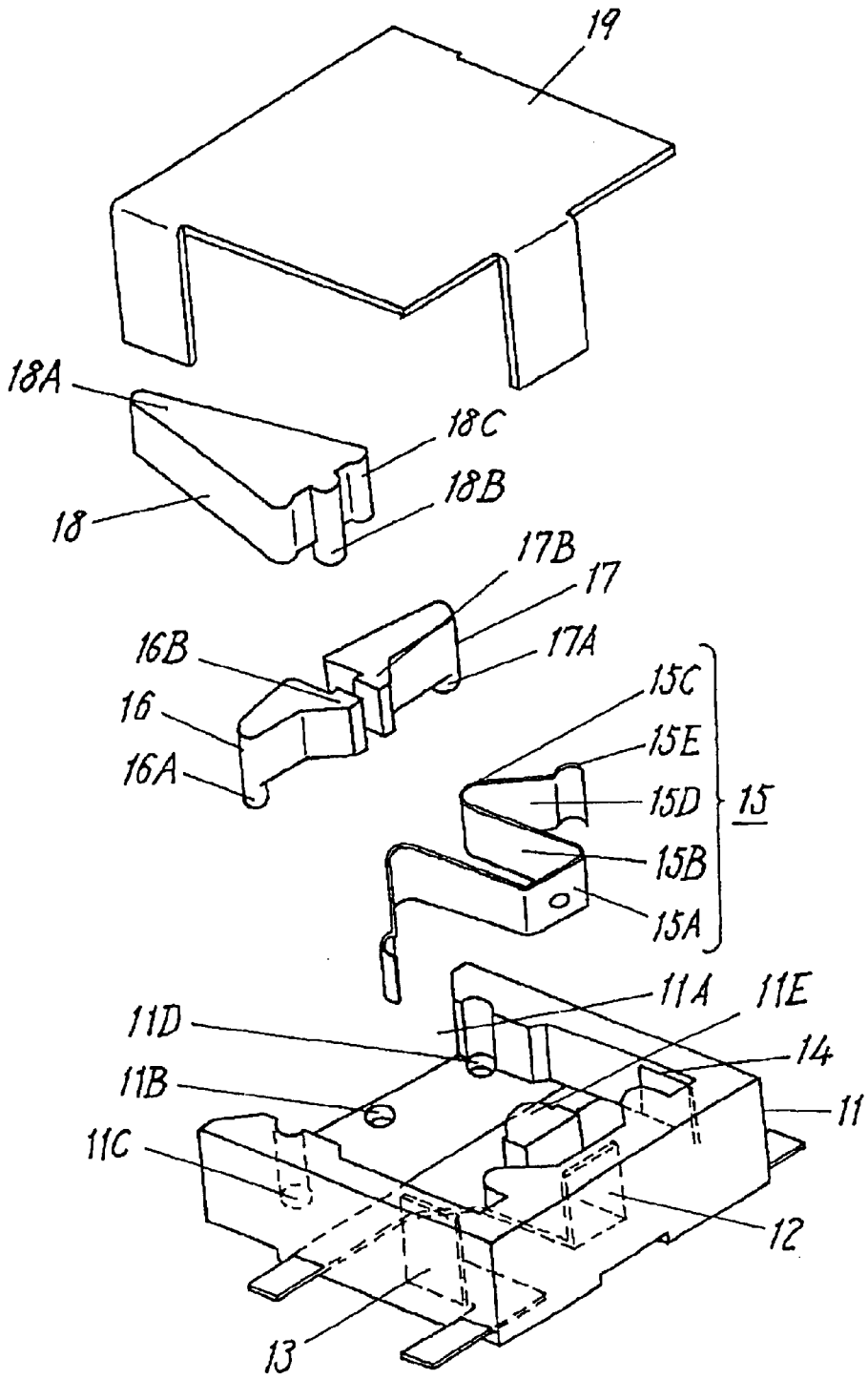
FIG. 2 is an exploded perspective view of the same lever switch.

FIG. 1 is a sectional view of a lever switch according to the first exemplary embodiment of this invention, and FIG. 2 is an exploded perspective view of the same. Box-shaped case 11 made of insulating plastic has an open front and opening 11A in an upper surface. The case 11 is provided with common contact 12 made of conductive metal on an inner bottom surface, and a couple of stationary contacts 13 and 14 also made of conductive metal disposed respectively to both left and right inner walls that confront each other. They are placed in their respective positions and secured to the case 11 by such means as insert molding and the like. The case 11 is also provided with bearing hole 11B in an upper center part of its inner back wall, and supporting holes 11C and 11D respectively at left and right sides of the bearing hole 11B. A projecting retainer post 11E is formed in a relatively lower center part of the case 11.

Movable contact 15 in the shape of generally a letter M is made of a thin flexible plate of metal such as phosphor bronze, beryllium copper, and the like. Boss 15P of a semispherical shape formed on a bottom surface of middle part 15A of the movable contact 15 is resiliently in contact with the common contact 12. First arms 15B extending from both ends of the middle part 15A stay in contact with the retainer post 11E. The movable contact 15 is bent in an outwardly extending manner at turnover parts in continuity from ends of both the first arms 15B. Contact points 15E in continuity with ends of the second arms 15D extending from the turnover parts 15C are outwardly curved, and they are in contact resiliently with the left and the right inner walls of the case 11.

A pair of cams 16 and 17 on both left and right sides are provided with cylindrical supporting axles 16A and 17A, formed at their respective one ends. The supporting axles 16A and 17A are inserted into the support holes 11C and 11D, thereby rendering the cams 16 and 17 individually rotatable. In addition, lower surfaces of depressing parts 16B and 17B at the other ends of the respective cams 16 and 17 are in contact to the turnover parts 15C or the vicinities thereof on both sides of the movable contact 15.

An upper end of the lever 18 made of insulating plastic, forming manipulating part 18A, projects upward from the opening 11A of the case 11. Cylindrical axle 18B at lower end of the lever 18 is fitted rotatably in the bearing hole 11B of the case 11. Two circularly curved protuberant parts 18C at both ends of a lower surface of the lever 18 are also in contact to upper surfaces of the depressing parts 6B and 17B of the cams 16 and 17 respectively.

A front face of the case 11 in which the above structural members are housed is covered with cover 19.

Figure 3:
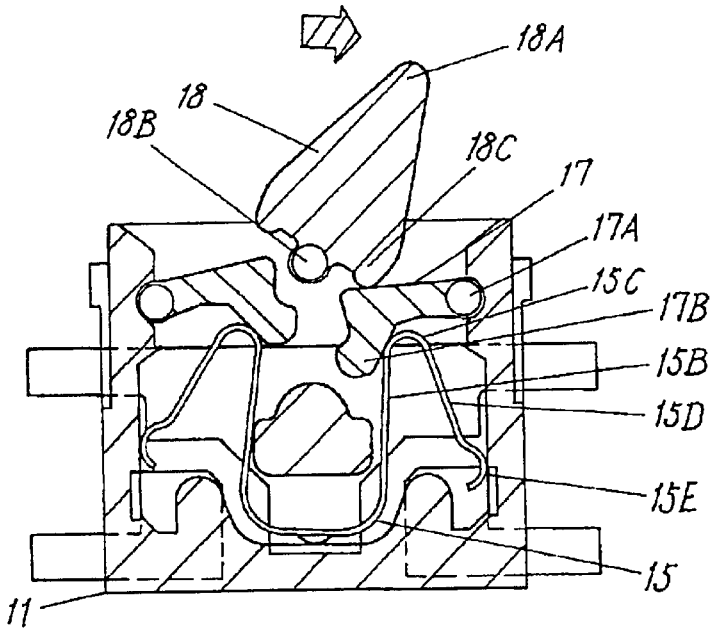
FIG. 3 is a sectional view of the same lever switch with a lever turned partway.

In the foregoing structure, when the manipulating part 18A of the lever 18 is turned rightward from its neutral position shown in FIG. 1, the lever 18 turns about the axle 18B as shown in the sectional view of FIG. 3. This turning movement causes the protuberant part 18C on the right bottom surface of the lever 18 to depress the upper surface of the depressing part 17B of the cam 17, and to turn the cam 17 downward about the supporting axle 17A serving as a fulcrum. As a result, the depressing part 17B of the cam 17 depresses the turnover part 15C at the right side of the movable contact 15, bends the first arm 15B and the second arm 15D at the right side, and makes the right side contact point 15E slide resiliently downward on the inner right wall of the case 11.

Figure 4:
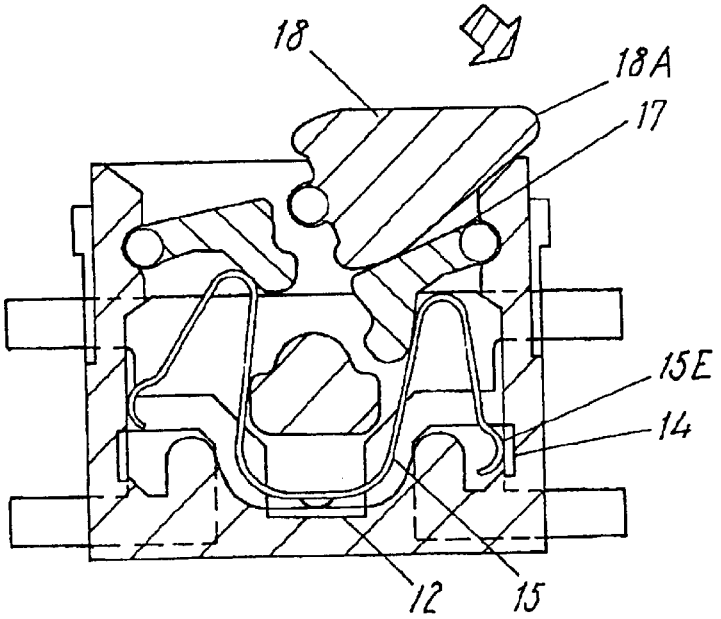
FIG. 4 is a sectional view of the same lever switch with the lever turned to its full swing.

When the manipulating part 18A of the lever 18 is turned further to the right thereafter, the contact point 15E of the movable contact 15 slides resiliently further downward, and comes in contact to the stationary contact 14 as shown in the sectional view of FIG. 4. As a result, the stationary contact 14 and the common contact 12 are connected electrically through the movable contact 15.

When a manipulatory force to the manipulating part 18A of the lever 18 is released, a resilient returning force of the movable contact 15 causes the contact point 15E to resiliently slide upward to separate itself from the stationary contact 14, and pushes up the depressing part 17B of the cam 17. This turns the lever 18, and returns the manipulating part 18A into the neutral position as shown in FIG. 1.

Or, when the manipulating part 18A of the lever 18 is turned leftward, the protuberant part 18C on the left depresses the upper surface of the depressing part 16B of the cam 16, the left side contact point 15E of the movable contact 15 slides resiliently downward to come into contact to the stationary contact 13. As a result, the stationary contact 13 and the common contact 12 are connected electrically through the movable contact 15.

According to this exemplary embodiment as described, the movable contact 15 comprised of the middle part 15A, the first arms 15B, turnover parts 15C and the second arms 15D is formed in the shape of generally a letter M. The entire movable contact 15 is bent in a manner that the middle part 15A is resiliently in contact with the common contact 12, and the contact points 15E at both ends to the inner walls of the case or to the stationary contacts 13 and 14. The structure constructed as above makes possible an increase in contact force of the movable contact 15, and reduction in size of the entire switch. Here, the shape and material of the flexible thin sheet metal used for the movable contact determine the contact force thereof. In addition, a certain amount of contact pressure can be ensured even if the lever 18 is in a position partway through the manipulation because of the structure, in which the contact points 15E of the movable contact 15 slide resiliently on the inner sidewalls of the case 11 to make and break a contact with one of the stationary contacts 13 and 14.

The movable contact 15 may be constructed with forming process using a round metal wire of copper alloy and the like, to obtain similar advantageous feature. However, products of steady shape and size can be made more easily and less expensively by press forming with a metal die using a thin flexible sheet metal.

In addition, the retainer post 11E disposed to the center part of the case 11 in a manner to abut against the first arms 15B of the movable contact 15 can support the movable contact 15 reliably, thereby preventing the movable contact 15 from irregular deformation and the like. Furthermore, during assembly of the switch, individual component parts can be mounted easily into the case 11, since the cams 16 and 17 can be set in places after the movable contact 15 is bent and held in advance in a predetermined position by virtue of the retainer post 11E.

The above-described switch represents one of the so-called normally-open type, in which turning manipulation of the lever 18 connects any of the contact points 15E at both ends of the movable contact 15 with respective one of the stationary contacts 13 and 14. However, it is also feasible to compose a so-called normally-close type lever switch by changing positions of the stationary contact 13 and 14, thereby the contact points 15E remain in contact with the stationary contacts 13 and 14 when the lever 18 is in its neutral position, and one of the contact points 15E breaks its connection with respective one of the stationary contacts 13 and 14 when the lever 18 is turned.

(Second Exemplary Embodiment)

Figure 5:
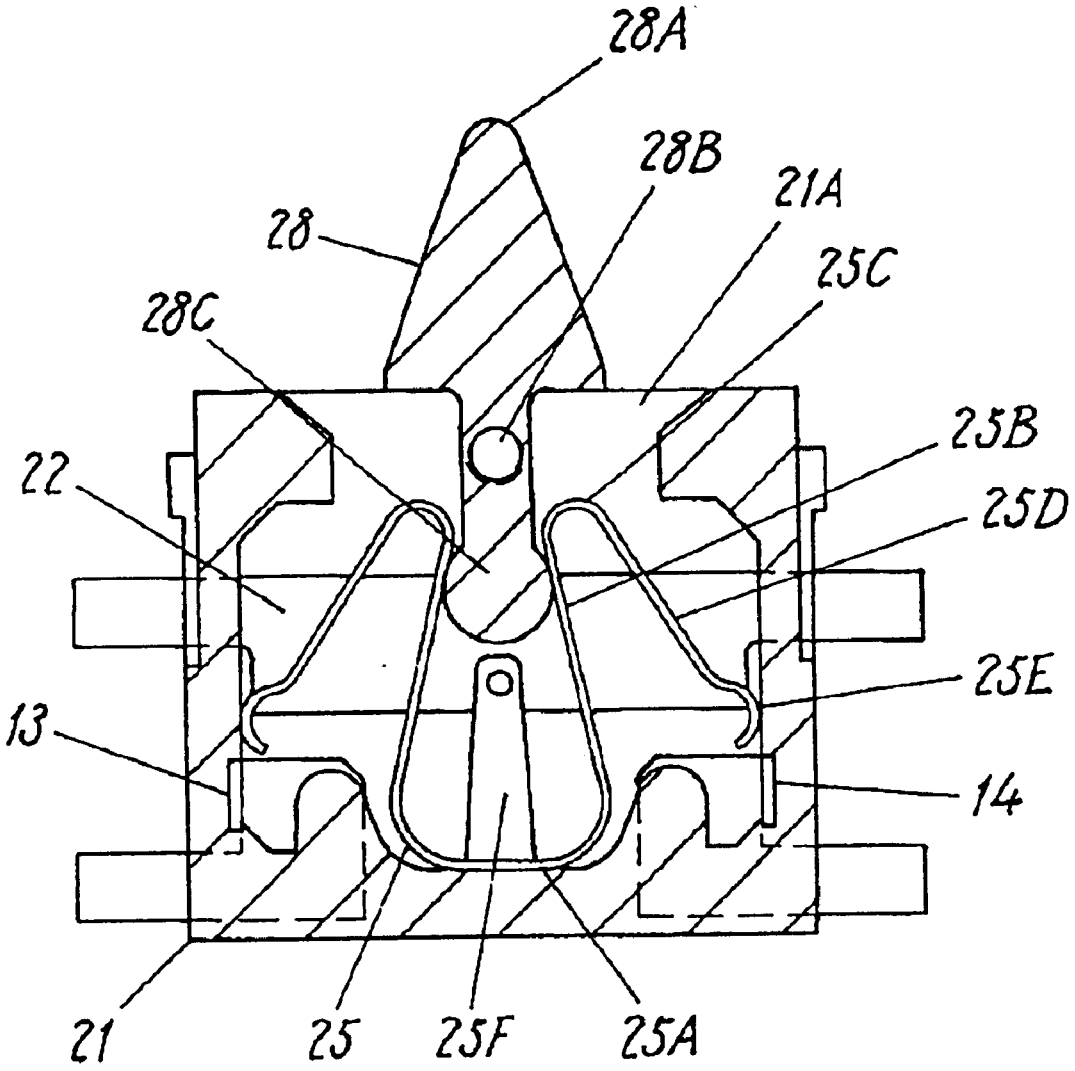
FIG. 5 is a sectional view of a lever switch according to a second exemplary embodiment of this invention.
Figure 6:
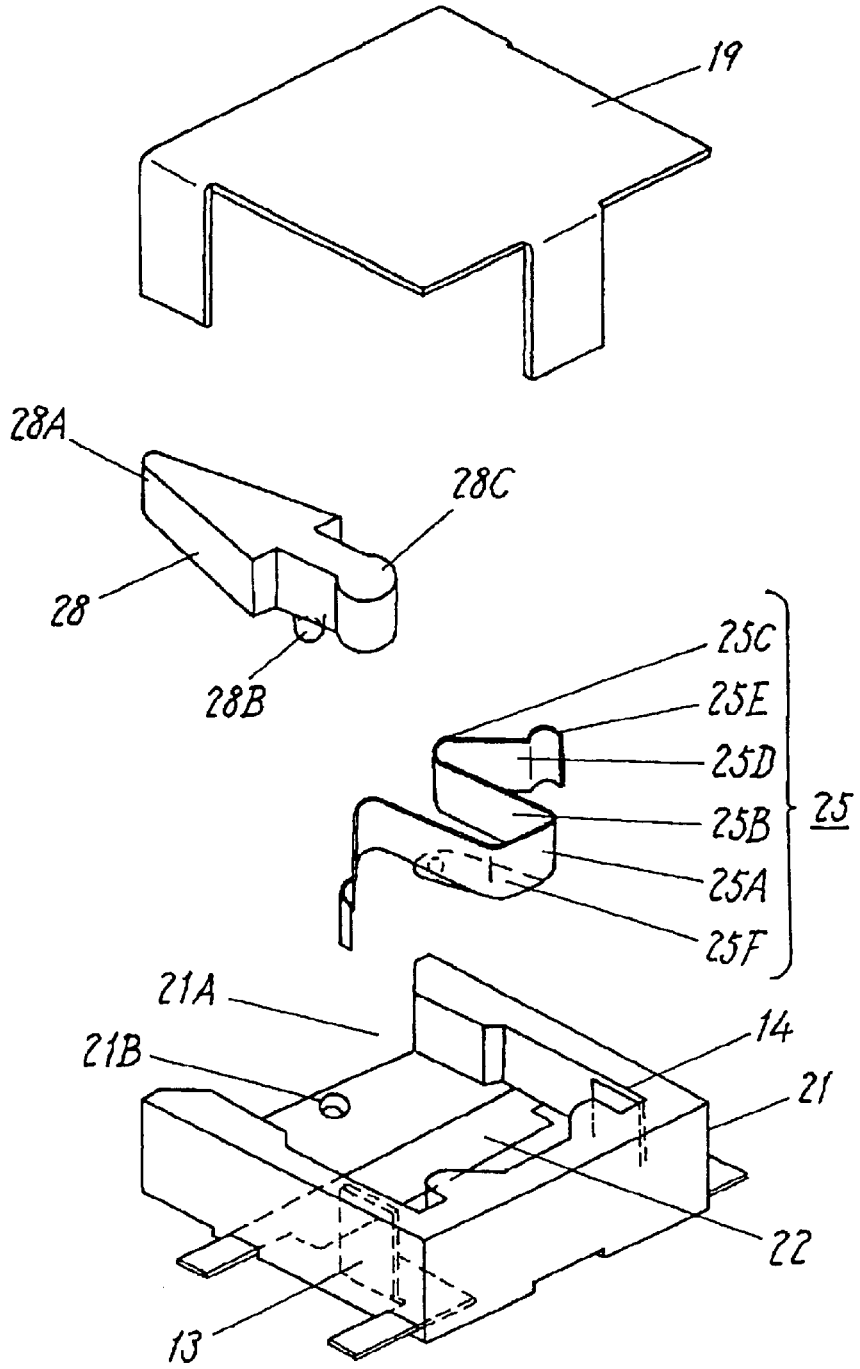
FIG. 6 is an exploded perspective view of the same lever switch.

FIG. 5 is a sectional view of a lever switch according to the second exemplary embodiment of this invention, and FIG. 6 is an exploded perspective view of the same. Box-shaped case 21 made of insulating plastic has an open front and opening 21A in its upper surface. The case 21 is provided with common contact 22 made of conductive metal on a center part of its back wall, and a couple of stationary contacts 13 and 14 also made of conductive metal disposed to both left and right inner walls that confront each other, by such means as insert molding and the like. The case 21 is also provided with bearing hole 21B in an upper center part of the back wall. Like reference numerals are used to designate like structural components as those of the first exemplary embodiment, and their details will be skipped.

Generally M-shaped movable contact 25 made of a thin flexible metal plate has first arms 25B extending from both ends of middle part 25A toward its left and right sides, turnover parts 25C in continuity from ends of the first arms 25B, and contact points 25E in continuity from ends of second arms 25D extending from the turnover parts 25C, in the same manner as that of the first exemplary embodiment. The contact points 25E are in contact resiliently with the left and the right inner walls of the case 21.

In this exemplary embodiment, there is tab 25F provided in a manner to extend upwardly from the center of the middle part 25A. A distal end of the tab 25F is resiliently in contact with the common contact 22.

Also, an upper end of lever 28 serving as manipulating part 28A projects upwardly from the opening 21A of the case 21, and cylindrical axle 28B at the center of the lever 28 is fitted rotatably in the bearing hole 21B of the case 21, in the like manner as in the case of the first exemplary embodiment.

In the lever switch of this exemplary embodiment, the lever 28 is provided at its bottom end with cylindrically shaped actuating part 28C extending downwardly from the cylindrical axle 28B, in place of the cams 16 and 17 of the first exemplary embodiments. The right and left sides of this actuating part 28C abut with the first arms 25B of the movable contact 25. A front face of the case 21 in which the above components are housed is covered with cover 19.

Figure 7:
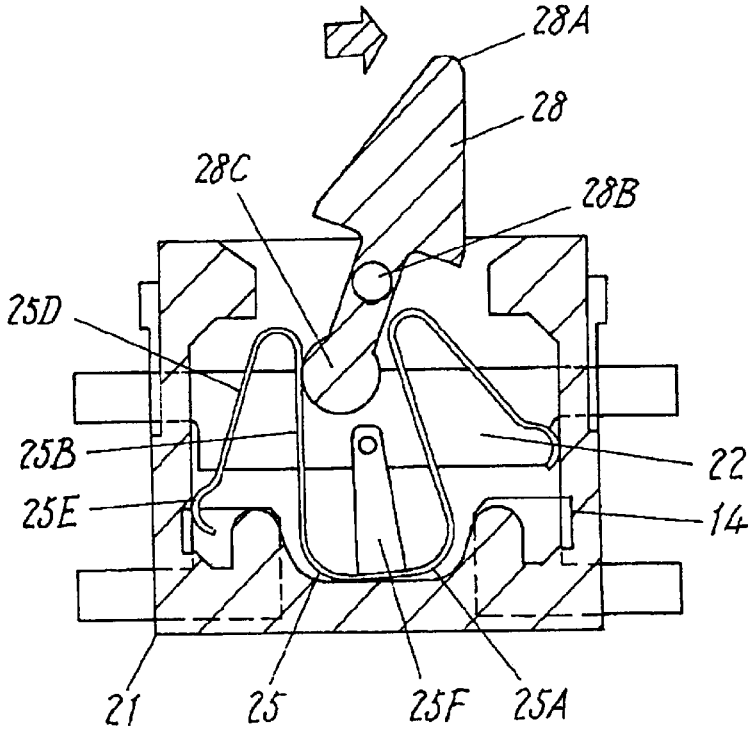
FIG. 7 is a sectional view of the same lever switch with a lever turned partway.
Figure 8:
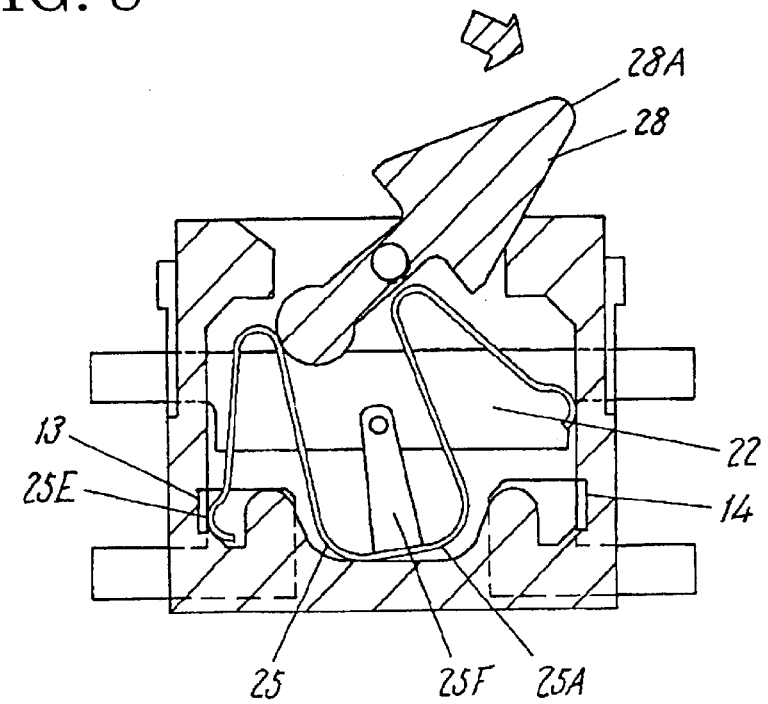
FIG. 8 is a sectional view of the same lever switch with the lever turned to its full swing.

In the foregoing structure, when the manipulating part 28A of the lever 28 is turned rightward from its neutral position as shown in FIG. 5, the lever 28 rotates about the axle 28B as shown in the sectional view of FIG. 7. This causes a left side of the actuating part 28C of the lever 28 to depress the first arm 25B at the left side of the movable contact 25, bends the first arm 25B and the second arm 25D, and makes the left side contact point 25E slide resiliently downward on the inner left wall of the case 21. When the manipulating part 28A of the lever 28 is turned further, the contact point 25E of the movable contact 25 slides resiliently further downward as shown in the sectional view of FIG. 8. As a result, the contact point 25E comes into contact to the stationary contact 13, to connect electrically between the stationary contact 13 and the common contact 22 through the movable contact 25. During this operation, the distal end of the tab 25F provided to extend upwardly from the middle part 25A of the movable contact 25 slides resiliently toward the left on the common contact 22 in concert with the above movement of the movable contact 25.

When a manipulatory force to the manipulating part 28A of the lever 28 is released, a resilient returning force of the movable contact 25 causes the contact point 25E to resiliently slide upward to separate itself from the stationary contact 13. At the same time, the left side of the actuating part 28C of the lever 28 is pushed back toward the right side by the first arm 25B at the left side of the movable contact 25. This turns the lever 18, and returns the manipulating part 18A to its neutral position shown in FIG. 1.

Or, when the manipulating part 28A of the lever 28 is turned leftward, the right side of the manipulating part 28A depresses the first arm 25B at the right side of the movable contact 25, causing the right side contact point 25E of the movable contact 25 slide resiliently downward to bring it into contact to the stationary contact 14, and thereby establishing an electrical connection between the stationary contact 14 and the common contact 22 through the movable contact 25.

As has been described, the lever switch of this exemplary embodiment has such structure that the lever 28 has the actuating part 28C extending downward from its axle 28B, instead of the cams provided in the first exemplary embodiment, and that the right and left sides of this actuating part 28C abut with inner sides of the first arms 25B of the movable contact 25. Adoption of this structure makes it unnecessary to use the cams to actuate the movable contact 25, thereby realizing further reduction of its size and cost.

In addition, the lever switch of this exemplary embodiment has the tab 25F, of which the distal end slides resiliently on the common contact 22 in concert with a movement of the movable contact 25. This helps remove foreign particles such as dust, carbonized matter, and the like on surface of the common contact 22, and thereby it realizes reliable conductivity of the contacts.

What is claimed is:

1. A lever switch comprising:

a case (11) having an opening in an upper surface, provided with a common contact (12) and at least one stationary contact (13, 14), said common contact (12) being disposed to a center area of a first inner wall of said case (11), and said at least one stationary contact (13, 14) being disposed to any of a second inner wall and a third inner wall opposite each other in said case (11);

a movable contact (15) having a middle part (15A), first arms (15B) extending from both ends of said middle part (15A) in a direction vertical to said first inner wall, turnover parts (15C) in continuity with ends of said first arms (15B), second arms (15D) in continuity with ends of said turnover parts (15C), and contact points (15E) in continuity with said second arms (15D), said middle part (15A) being in contact resiliently with said common contact (12) at all times, and said contact points (15E) being in contact resiliently with said second inner wall and said third inner wall respectively in a slidable manner;

a pair of cams (16, 17) disposed rotatably to a fourth inner wall of said case (11), a lower surface of a depressing part of each of said pair of cams (16, 17) abutting upon a respective one of the turnover parts (15C) of said movable contact (15); and a lever (18) disposed rotatably to said fourth inner wall of said case (11), a lower side of said lever (18) abutting upon said depressing parts (16B, 17B) of said pair of cams (16, 17), and an upper part of said lever (18) projecting through said opening in said case (11), wherein one of said contact points (15E) makes resilient contact with respective one of said at least one stationary contact (13, 14) in concert with a turning movement of said lever (18).

2. The lever switch as set forth in claim 1, wherein said first arms (15B), said turnover parts (15C), said second arms (15D) and said contact points (15E) of said movable contact (15) extend symmetrically to the left and right from said middle part (15A), and said movable contact (15) is formed into the shape of generally a letter M.

3. The lever switch as set forth in claim 1, wherein said movable contact (15) is made of a thin flexible metal sheet.

4. The lever switch as set forth in claim 1, wherein said case (11) further has a retainer post (11E) in a center part of said fourth inner wall, said retainer post (11E) being in contact with said first arms (15B) of said movable contact (15).

5. A lever switch comprising:

a case (21) having an opening in an upper surface, provided with a common contact (22) and at least one stationary contact (13, 14), said common contact (22) being disposed to a center area of a first inner wall of said case (21), and said stationary contact (13, 14) being disposed to any of a second inner wall and a third inner wall opposite each other in said case (21);

a movable contact (25) having a middle part (25A), first arms (25B) in continuity from both ends of said middle part (25A), turnover parts (25C) in continuity with ends of said first arms (25B), second arms (25D) in continuity with ends of said turnover parts (25C), contact points (25E) in continuity with said second arms (25D), and a tab (25F) extending from said middle part (25A), an end of said tab (25F) being in contact resiliently with said common contact (22), and said contact points (25E) being in contact resiliently with said second inner wall and said third inner wall in a slidable manner; and a lever (28) having a downwardly extending cylindrical actuating part (28C) and disposed to said first inner wall in a rotatable manner, right and left sides of said actuating part (28C) abutting against respective ones of said first arms 25B of said movable contact (25) and an upper part of said lever (28) projecting through said opening in said case (21), wherein one of said contact points (25E) makes resilient contact with respective one of said at least one stationary contact (13, 14) in concert with a turning movement of said lever (28).

6. The lever switch as set forth in claim 5, wherein said first arms (25B), said turnover parts (25C), said second arms (25D) and said contact points (25E) of said movable contact (25) extend symmetrically to the left and right from said middle part (25A), and said movable contact (25) is formed into the shape of generally a letter M.

7. The lever switch as set forth in claim 5, wherein said movable contact (25) is made of a thin flexible metal sheet.

* * * * *